US005464260A

United States Patent [19]

Bartel et al.

[11] Patent Number: 5,464,260

[45] Date of Patent: Nov. 7, 1995

[54] ELECTROMECHANICAL DRIVE FOR A MOTOR-VEHICLE POWER DOOR LATCH

[75] Inventors: Peter Bartel, Hattingen; Hans-Joachim Büscher, Düsseldorf, both of Germany

[73] Assignee: Kiekert GmbH & Co. KG, Heiligenhaus, Germany

[21] Appl. No.: 156,476

[22] Filed: Nov. 23, 1993

[30] Foreign Application Priority Data

Feb. 27, 1993 [DE] Germany ..... 43 06 212.1

[51] Int. Cl.[6] ..... E05C 3/06

[52] U.S. Cl. ..... 292/201; 292/DIG.23; 74/96; 192/139; 192/150

[58] Field of Search ..... 292/201, 336.3, 292/DIG. 23, DIG. 27, DIG. 3; 74/96; 192/138, 139, 150, 56 R

[56] References Cited

U.S. PATENT DOCUMENTS

| | | | |
|---|---|---|---|
| 2,256,781 | 9/1941 | Nelson | 192/150 |
| 4,610,340 | 9/1986 | Helmes et al. | 192/56 R |
| 4,669,283 | 6/1987 | Ingenhoven . | |
| 5,261,711 | 11/1993 | Mizuki et al. | 292/201 |

FOREIGN PATENT DOCUMENTS 9012785 3/1991 Germany .

*Primary Examiner*—Rodney M. Lindsey
*Attorney, Agent, or Firm*—Herbert Dubno; Andrew Wilford

[57] ABSTRACT

A motor-vehicle door latch has a drive having a housing formed with an inner surface formed relative to a main axis traversing the housing with two angularly offset and radially inwardly open notches, a shaft rotatable in the housing about the main axis and having a radially outwardly projecting bump, and a wheel rotatable in the housing about the main axis, surrounding the shaft in the housing, and connected to the input member of the latch to rotate jointly with the input member between locked and unlocked positions of the latch. A lobe on the wheel projects radially outward into one of the notches. A radially outwardly deflectable abutment on the wheel is angularly engageable with the bump of the shaft and is urged by a spring radially inward on the wheel so that the bump can angularly engage the abutment and angularly displace the wheel. A rocker pivotal on the wheel about a rocker axis generally parallel to the main axis and angularly offset from the abutment has an end offset angularly from the rocker axis and formed with an outwardly directed tooth engageable in the other notch only in the locked position of the wheel. The bump and an inner surface of the rocker are dimensioned such that, when the wheel is in the locked position, engagement of the bump with the end of the rocker forces the tooth radially outward into the other notch and thereby angularly blocks the wheel in the housing.

8 Claims, 3 Drawing Sheets

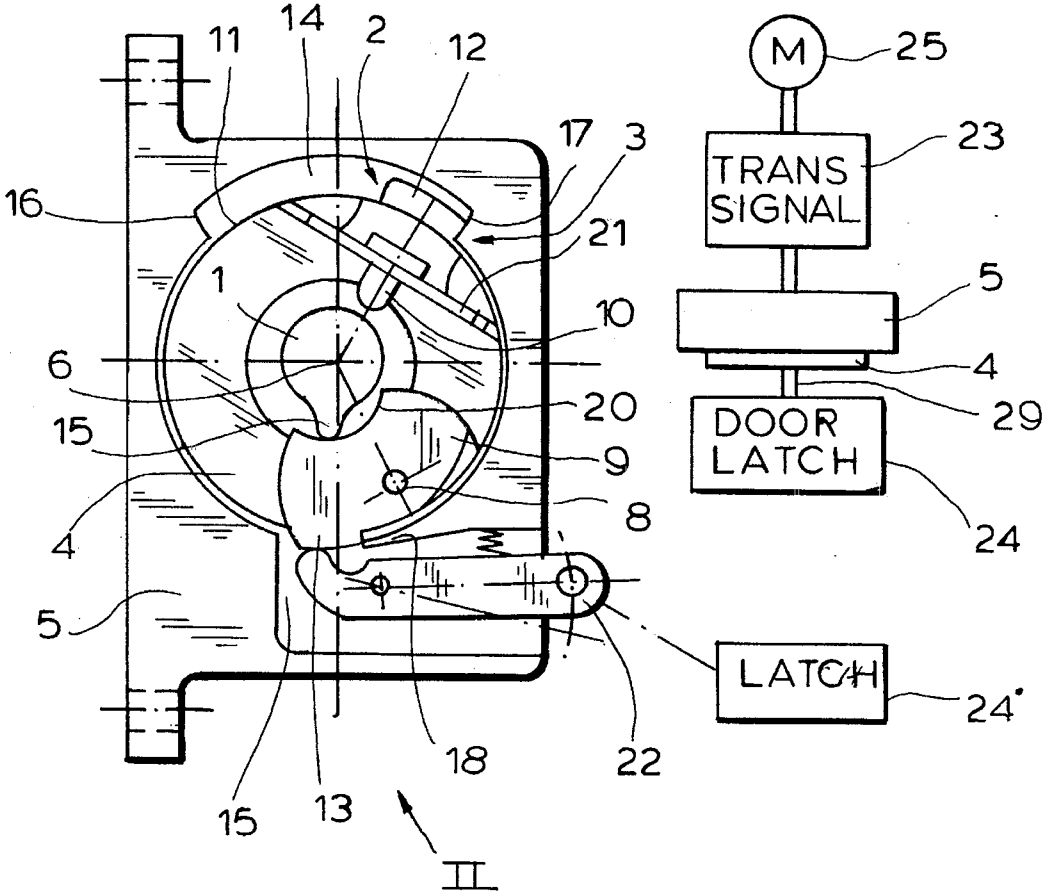
FIG. 9
FIG 8
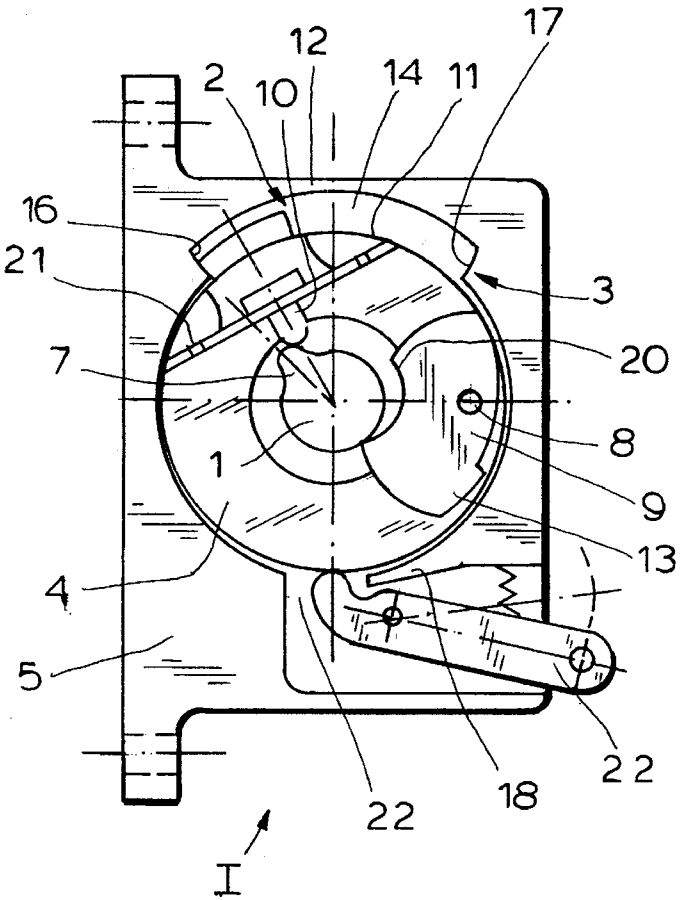
FIG. 7

ELECTROMECHANICAL DRIVE FOR A MOTOR-VEHICLE POWER DOOR LATCH

FIELD OF THE INVENTION

The present invention relates to an electromechanical drive for a motor-vehicle power door latch. More particularly this invention concerns such a door latch used in a central locking system.

BACKGROUND OF THE INVENTION

In a standard power-lock system, which is invariably centrally controllable, it is becoming standard to set up the individual door latches so that they have, in addition to the standard locked and unlocked positions, an antitheft position. While in the locked position it is still possible for a person to unlock and then open a door from inside the vehicle, typically by first actuating the inside locking button or lever to unlock the door, in the antitheft position the door cannot be opened even from inside. Thus the inside locking element is disconnected from the respective latch mechanism or is blocked against movement. Thus a person who, for example, breaks the vehicle window, cannot simply reach inside and unlock the door. A drive for such a system having a slider as the actuating element is described in commonly owned earlier U.S. Pat. No. 4,669,283.

In another known system described in German utility model 9,012,785 filed 7 Sep. 1990 (with a priority claim to German 8,910,972 filed 14 Sep. 1989) uses a rotary actuating element that is moved between two angularly offset positions between the locked and unlocked positions, and that is retained in the locked position in the antitheft position. Such a system has some advantages over other prior-art arrangements but is still fairly complex.

OBJECTS OF THE INVENTION

It is therefore an object of the present invention to provide an improved three-position drive mechanism for a power door latch.

Another object is the provision of such an improved three-position drive mechanism for a power door latch which overcomes the above-given disadvantages, that is which is fairly simple in construction and sure in operation.

SUMMARY OF THE INVENTION

The drive according to the invention is used in combination with a reversible electric motor and with a motor-vehicle door latch having an input member movable between a locked position and an unlocked position. The drive has a housing having an inner surface formed relative to a main axis traversing the housing with two angularly offset and radially inwardly open notches, a shaft rotatable in the housing about the main axis and having a radially outwardly projecting bump, and a wheel rotatable in the housing about the main axis, surrounding the shaft in the housing, and connected to the input member of the latch to rotate jointly with the input member between the locked and unlocked positions. A lobe on the wheel projects radially outward into one of the notches which has a front end surface engaging the lobe in the unlocked position of the wheel and member and a rear end surface engaging the lobe in the locked position of the wheel and member. A radially outwardly deflectable abutment on the wheel is angularly engageable with the bump of the shaft and is urged by a spring radially inward on the wheel so that the bump can angularly engage the abutment and angularly displace the wheel when the wheel is not blocked by engagement of the lobe against one of the end surfaces. The spring has such a force that when the wheel is blocked by engagement of the lobe against a one of the end surfaces the lobe can outwardly deflect the abutment and move angularly past it. A rocker pivotal on the wheel about a rocker axis generally parallel to the main axis and angularly offset from the abutment has an end offset angularly from the rocker axis and formed with an outwardly directed tooth engageable in the other notch only in the locked position of the wheel. The rocker has an inner surface engageable with the bump. The bump and inner surface are dimensioned such that, when the wheel is in the locked position, engagement of the bump with the end of the rocker forces the tooth radially outward into the other notch and thereby angularly blocks the wheel in the housing.

This is a very simple system using rotary action. It is relatively easy to replace the linear sliding action of the prior art with rotary movement and thereby produce a very simple, compact, and robust assembly. The use of a hollow wheel allows the system to operate with relatively low torque, but to resist movement when in the antitheft position with considerable torque. The entire assembly can be made rather simply and built right onto the housing of the latch.

The wheel and rocker according to the invention are made of a synthetic resin. In addition a transmission is provided between the electric motor and the shaft. The rocker has an inner surface engageable with the bump and formed with a central portion generally radially aligned with the rocker pivot and spaced a relatively large radial distance from the main axis and a pair of end portions flanking the central portion and spaced a relatively small distance from the main axis. Thus as the bump sweeps over the inner surface it moves the rocker in one direction and then in the other.

The spring in accordance with this invention is a secantally extending leaf spring. The notches are generally diametrically opposite each other. The wheel can act directly on the latch or an actuating lever carried on the housing and pivotable by the tooth of the rocker when same is engaged in the other notch is connected to the latch to displace same into an antitheft position.

BRIEF DESCRIPTION OF THE DRAWING

The above and other objects, features, and advantages will become more readily apparent from the following description, reference being made to the accompanying drawing in which:

FIGS. 7 and 8 are end views of another drive coupling in the unlocked and antitheft positions, respectively; and FIG. 9 is a small-scale schematic view illustrating the overall lock system using the coupling of FIGS. 1 through 6.

SPECIFIC DESCRIPTION

Figure 3:
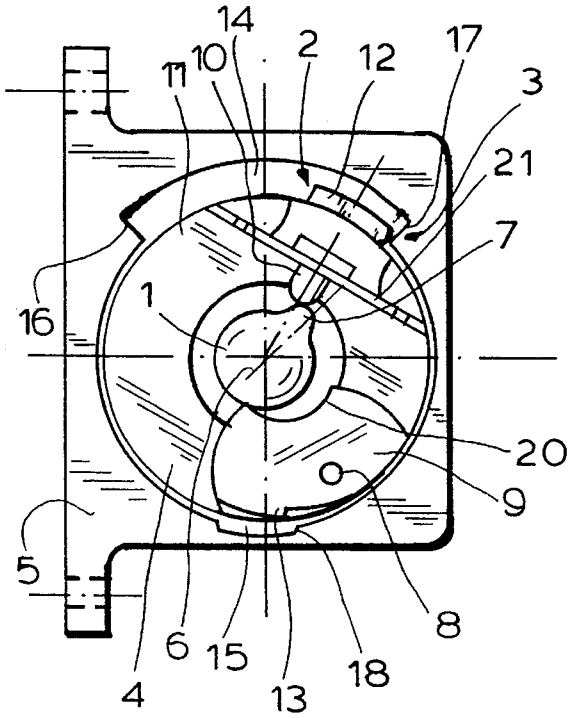
FIG. 3 is the drive in the locked position.
Figure 2:
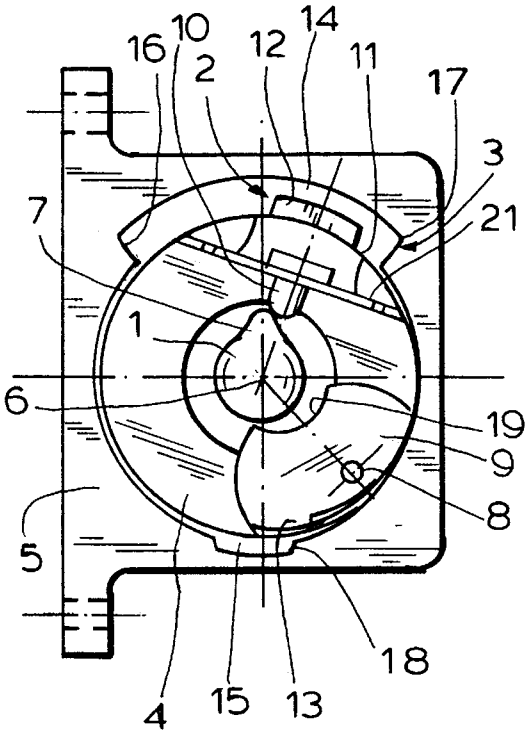
FIG. 2 is the drive partially moved from the unlocked to the locked position.

As seen in FIG. 9 a lock system has a reversible electric motor 25 connected through a stepdown transmission 23 to a shaft 1 that extends into a housing 5. An output element 4 rotatable in the housing 5 is connected to an input member 29 of a door latch 24 to move it between the locked and unlocked positions. Normally the input member 29 is internal and the housing 5 of the drive is integral with the housing of the latch 24.

Figure 1:
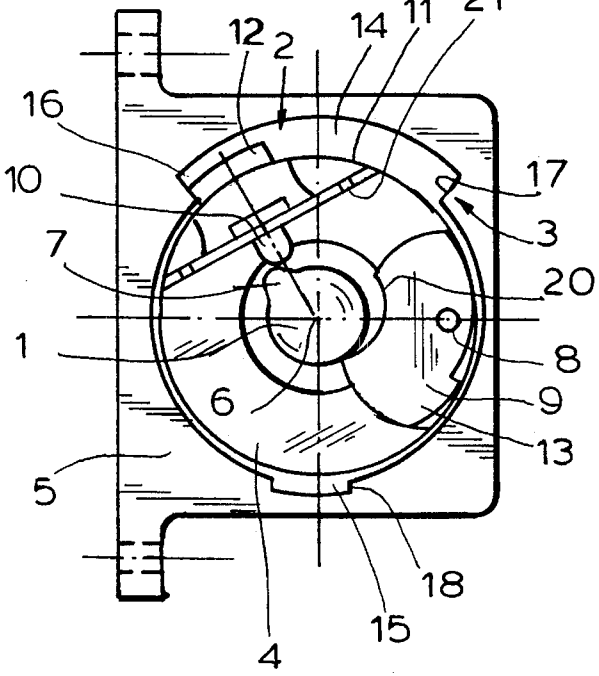
FIG. 1 is an end view of the drive coupling of the present invention in the unlocked position.

According to the invention as seen in FIGS. 1 through 6, the output element 4 is a hollow wheel 4 rotatable coaxially with the shaft 1 about an axis 6. A stop arrangement 2 defining unlocked and locked positions shown respectively in FIGS. 1 and 3 is formed by an outwardly projecting bump or lobe 12 fixed to the wheel 4 and an inwardly open pocket 14 formed in an inner wall 26 of the housing 5 and having a front and back stop-defining end surfaces 16 and 17 against which the bump 12 engages in the unlocked and locked positions, respectively.

The shaft 1 is formed with a radially outwardly projecting bump or lobe 7 that can engage the inner end of a radially displaceable abutment pin 10 that is angularly fixed in the wheel 4. A leaf spring 21 urges this abutment 10 inward toward the axis 6 with sufficient force that if the lobe 7 engages it, the wheel 4 will be rotated unless it is stopped by one of the surfaces 16 or 17.

A rocker 9 is pivotal on the wheel 4 about a pivot 8 that defines for the rocker 9 a pivot axis parallel to the main axis 6. This rocker 9 has an inner surface 20 of a radius of curvature that is somewhat smaller than a distance d from its central outermost region to the axis 6, which distance d is slightly greater than the spacing from the outermost part of the lobe 7 to the axis 6. The rocker 9 is provided on one of its ends offset angularly from the pivot 8 with an outwardly directed tooth 13 that can engage in an inwardly open notch 15 formed in an inner wall 26 of the housing 5. The distance D measured radially of the axis 6 between the outer surface of the tooth 13 and the inner surface 20 is greater than the radial distance between the outermost edge of the bump 7 and the inner surface 26 of the housing 4, so that the tooth 13 must be engaged in the notch 15 when the bump 7 is engaging the respective end of the rocker 9.

The actuator described above operates as follows:

Presuming that the mechanism is in the locked position of FIG. 1 with the lobe 12 engaging the end stop 16, the motor 25 operates to rotate the shaft 7 in the clockwise direction of arrow 27. This will bring the bump 7 into engagement with the abutment 10 to rotate the wheel 4 in the direction 27 through the position of FIG. 2 to the position of FIG. 3, in which the latch 24 is locked. Once the FIG. 3 position is reached further rotation of the shaft 1 in the direction 27 will cause the bump 7 to cam out the abutment 10 against the force of its spring 21 and to continue rotating, since engagement of the lobe 12 with the stop 17 inhibits further rotation of the wheel 4 in the direction 27.

Figure 4:
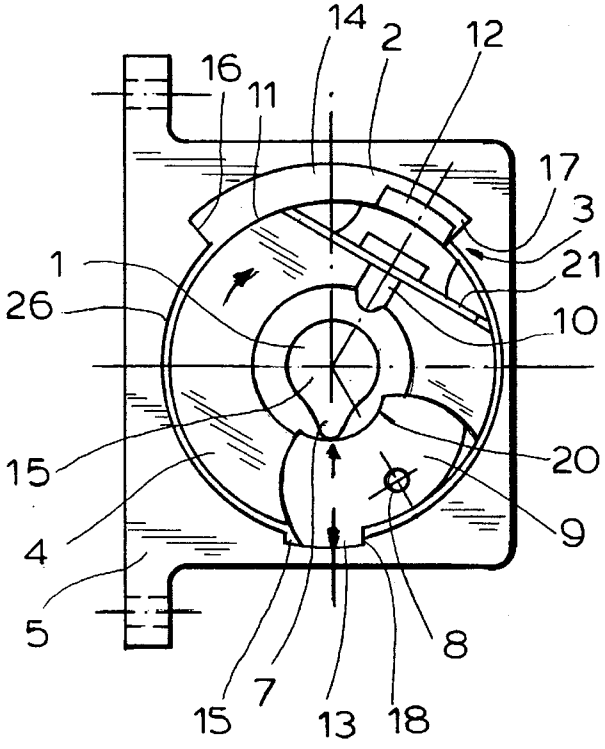
FIG. 4 is the drive in the antitheft position.

As the shaft 1 continues to rotate in the direction 27 it will ride along the surface 20 of the rocker 9 and, when it comes to the leading (relative to direction 27) end thereof it will push the rocker out so that the tooth 13 engages in the notch 15 as shown in FIG. 4. An attempt to unlock the door when in this positioned will be resisted as the tooth 13 engages backward against a trailing edge surface 18 of the notch 15. This is the antitheft position.

Figure 6:
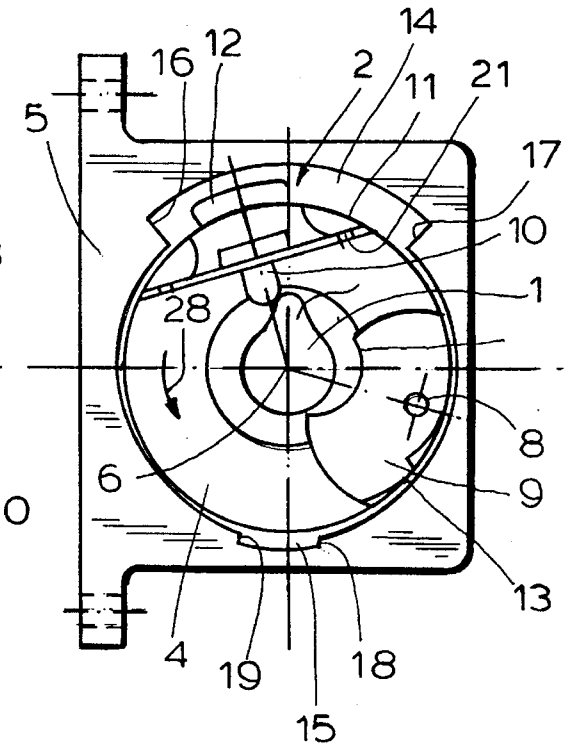
FIGS. 5 and 6 show the drive as it moves from the antitheft back to the unlocked position.
Figure 5:
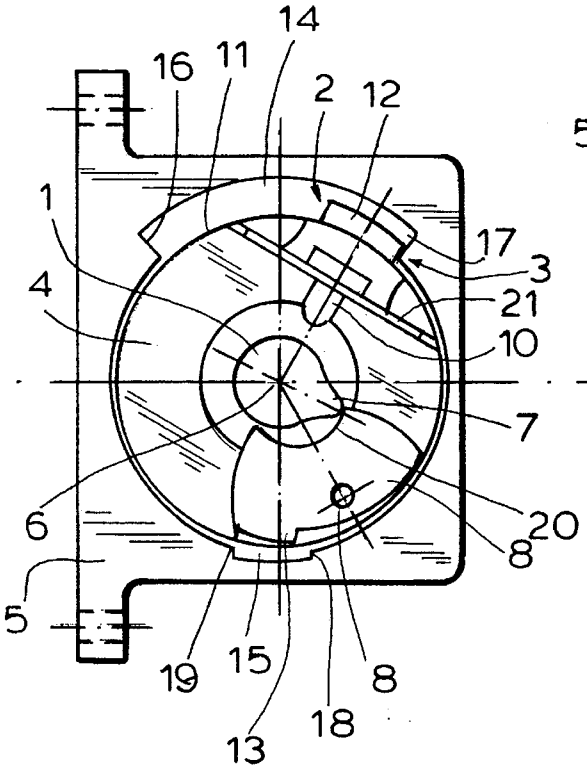

Subsequent reverse rotation of the shaft 1 in the counterclockwise direction of arrow 28 will first cause the bump 7 to push down on the trailing end of the rocker 9 and thereby lift the tooth 13 out of the notch 15, thereby restoring the coupling to the locked position as seen in FIG. 5. Continued rotation will bring the bump 7 into engagement with the rear edge of the abutment 10 to rotate the wheel 4 back toward the unlocked position as shown in FIG. 6. This will return the mechanism to the starting position of FIG. 1.

The arrangement of FIGS. 7 and 8 is substantially identical to that of FIG. 1, except that the housing 5 carries a lever 22 that is pivoted outward when the tooth 15 is engaged in the outer position in the antitheft position. This lever 22 is connected to mechanism in a conventional latch 24' that blocks or disconnects the inside door-unlocking element. Such an arrangement can readily be adapted to an existing antitheft-type door latch.

We claim:

1. In combination with a reversible electric motor and with a motor-vehicle door latch having an input member movable between a locked position and an unlocked position, a drive comprising:

a housing having an inner surface formed relative to a main axis traversing the housing with two angularly offset and radially inwardly open notches;

a shaft rotatable in the housing about the main axis and having a radially outwardly projecting bump;

a wheel rotatable in the housing about the main axis, surrounding the shaft in the housing, and connected to the input member of the latch to rotate jointly with the input member between the locked and unlocked positions;

a lobe on the wheel projecting radially outward into one of the notches, the one notch having a front end surface engaging the lobe in the unlocked position of the wheel and member and a rear end surface engaging the lobe in the locked position of the wheel and member;

a radially outwardly deflectable abutment on the wheel angularly engageable with the bump of the shaft;

a spring urging the abutment radially inward on the wheel, whereby the bump can angularly engage the abutment and angularly displace the wheel when the wheel is not blocked by engagement of the lobe against one of the end surfaces, the spring having such a force that when the wheel is blocked by engagement of the lobe against a one of the end surfaces the bump can outwardly deflect the abutment and move angularly past it; and a rocker pivotal on the wheel about a rocker axis generally parallel to the main axis, angularly offset from the abutment, and having an end offset angularly from the rocker axis and formed with an outwardly directed tooth engageable in the other notch only in the locked position of the wheel, the rocker having an inner surface engageable with the bump, the bump and inner surface being dimensioned such that, when the wheel is in the locked position, engagement of the bump with the end of the rocker forces the tooth radially outward into the other notch and thereby angularly blocks the wheel in the housing.

2. The motor-vehicle door-latch drive defined in claim 1 wherein the wheel is made of a synthetic resin.

3. The motor-vehicle door-latch drive defined in claim 1, further comprising a transmission between the electric motor and the shaft.

4. The motor-vehicle door-latch drive defined in claim 1 wherein the rocker is made of a synthetic resin.

5. The motor-vehicle door-latch drive defined in claim 1 wherein the rocker has an inner surface engageable with the bump and formed with a central portion generally radially aligned with the rocker pivot and spaced a relatively large radial distance from the main axis, and a pair of end portions flanking the central portion and spaced a relatively small distance from the main axis.

6. The motor-vehicle door-latch drive defined in claim 1 wherein the spring is a secantally extending leaf spring.

7. The motor-vehicle door-latch drive defined in claim 1 wherein the notches are generally diametrically opposite each other.

8. The motor-vehicle door-latch drive defined in claim 1, further comprising an actuating lever carried on the housing, pivotable by the tooth of the rocker when same is engaged in the other notch, and connected to the latch to displace same into an antitheft position.

* * * * *